US006527315B2

(12) United States Patent
Marks et al.

(10) Patent No.: US 6,527,315 B2
(45) Date of Patent: Mar. 4, 2003

(54) DOOR LATCH FOR A DISHWASHER

(75) Inventors: Larry D. Marks, St. Joseph, MI (US); John M. DeBoer, Findlay, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 35 days.

(21) Appl. No.: 09/748,819

(22) Filed: Dec. 22, 2000

(65) Prior Publication Data

US 2002/0079709 A1 Jun. 27, 2002

(51) Int. Cl.[7] ..... E05B 15/02

(52) U.S. Cl. ..... 292/341.15; 292/214; 292/216; 292/241; 292/336.3; 292/340; 292/341.17; 292/DIG. 38; 292/DIG. 53; 292/DIG. 55; 292/DIG. 69

(58) Field of Search ..... 292/341.15, DIG. 69, 292/216, 214, 241, 336.3, 340, 341.17, DIG. 53, DIG. 55, DIG. 38

(56) References Cited

U.S. PATENT DOCUMENTS 3,244,830 A * 4/1966 Bates ..... 200/61.68
3,328,062 A * 6/1967 Geiger et al. ..... 292/123
3,415,961 A * 12/1968 Barnard ..... 200/61.64
3,841,675 A * 10/1974 Mercer ..... 292/241
3,841,677 A * 10/1974 Guth ..... 292/335
3,899,230 A * 8/1975 Conrath et al. ..... 312/319
3,924,085 A * 12/1975 Stone ..... 200/61.62
3,997,201 A * 12/1976 DeSchaaf et al. ..... 292/173
4,585,261 A * 4/1986 Adams et al. ..... 292/216
4,776,620 A 10/1988 Marks et al. ..... 292/228
5,174,618 A * 12/1992 Krofp ..... 292/254
5,810,403 A 9/1998 Prada ..... 292/128
6,082,787 A * 7/2000 Chioffi et al. ..... 292/128
6,093,900 A * 7/2000 Wisskirchen et al. .... 200/302.2
6,145,898 A * 11/2000 Onderka et al. ..... 292/228
6,290,270 B1 * 9/2001 Spiessl ..... 292/226
6,431,615 B1 * 8/2002 Bastian ..... 292/80

* cited by examiner

*Primary Examiner*—Robert J. Sandy
*Assistant Examiner*—Carlos Lugo
(74) *Attorney, Agent, or Firm*—Stephen Krefman; John F. Colligan; Robert O. Rice

(57) ABSTRACT

A latch assembly for a dishwasher door having a bolt secured to the door. The bolt has a catch including a ramp surface facing toward the tub. An actuator is slidably connected to the bolt. A switch is secured to the bolt such that movement of the actuator may selectively close the switch. A handle is moveably mounted to the bolt in a position for access from the front surface of the door. A strike plate is connected to the tub and includes a latching portion extending toward the door. The strike plate flexes vertically to deflect up over the latch when the door moves to the closed position. The strike plate may be released from the latch by moving the handle upwardly.

10 Claims, 6 Drawing Sheets

DOOR LATCH FOR A DISHWASHER

BACKGROUND OF THE INVENTION

1. Field of the Invention

This invention relates generally to dishwashers and, more particularly, to a latching mechanism for a dishwasher door.

2. Description of the Prior Art

Known dishwashers include a hinged door and a latch mechanism which prevents operation of the dishwasher unless the door is latched in a closed position. In one known configuration, shown in U.S. Pat. No. 4,776,620, a fixed bolt is provided on the door of a dishwashing apparatus and cooperates with a strike plate on a cabinet, against which the door seats in a closed position, to latch the door in the closed position. The strike plate, in addition to latching the door, concurrently activates a switch, which is fixedly mounted on the door. The strike plate is deformable and is deflected by the bolt as the door is being closed and, upon the door closed position being realized, reassumes its undeflected state wherein it latches the door and activates the switch. Consequently, the structure will positively prohibit operation of the dishwashing apparatus until the door is latched.

SUMMARY OF THE INVENTION

The present invention is directed to a latch assembly for a dishwasher including a door having a front surface and a back surface and a tub. The latch assembly includes a bolt secured in a fixed position to the door, the bolt including a catch including a ramp surface facing toward the tub. An actuator is slidably connected to the bolt, the actuator having a top contact surface and a drive shoulder. A switch is secured to the bolt. The switch has a outwardly biased button and is mounted to the bolt such that movement of the actuator may selectively depress the outwardly biased button. A handle is moveably mounted to the bolt in a position for access from the front surface of the door. The handle has a drive surface. A strike plate is provided having extending outwardly from the tub. The strike plate includes a forward latching portion including a forward edge extending outwardly from the tub toward the rear surface of the door. The strike plate is able to flex vertically and upon the door moving toward a closed position the forward edge encounters the ramp surface and is deflected upwardly. Upon the door reaching a closed position, the latching portion of the strike plate clears the latch and deflects downwardly thereby contacting the actuator and forcing the actuator downwardly such that the outwardly biased button is depressed. The strike plate may be released from the latch by upwardly moving the handle such the drive surface of the handle engages the drive shoulder of the actuator moving the actuator upwardly such that the top contact surface forces the latching portion of the strike plate upwardly until the strike plate clears the catch of the bolt wherein the door may be pivoted to an open position.

DETAILED DESCRIPTION OF THE DRAWINGS

Figure 1:
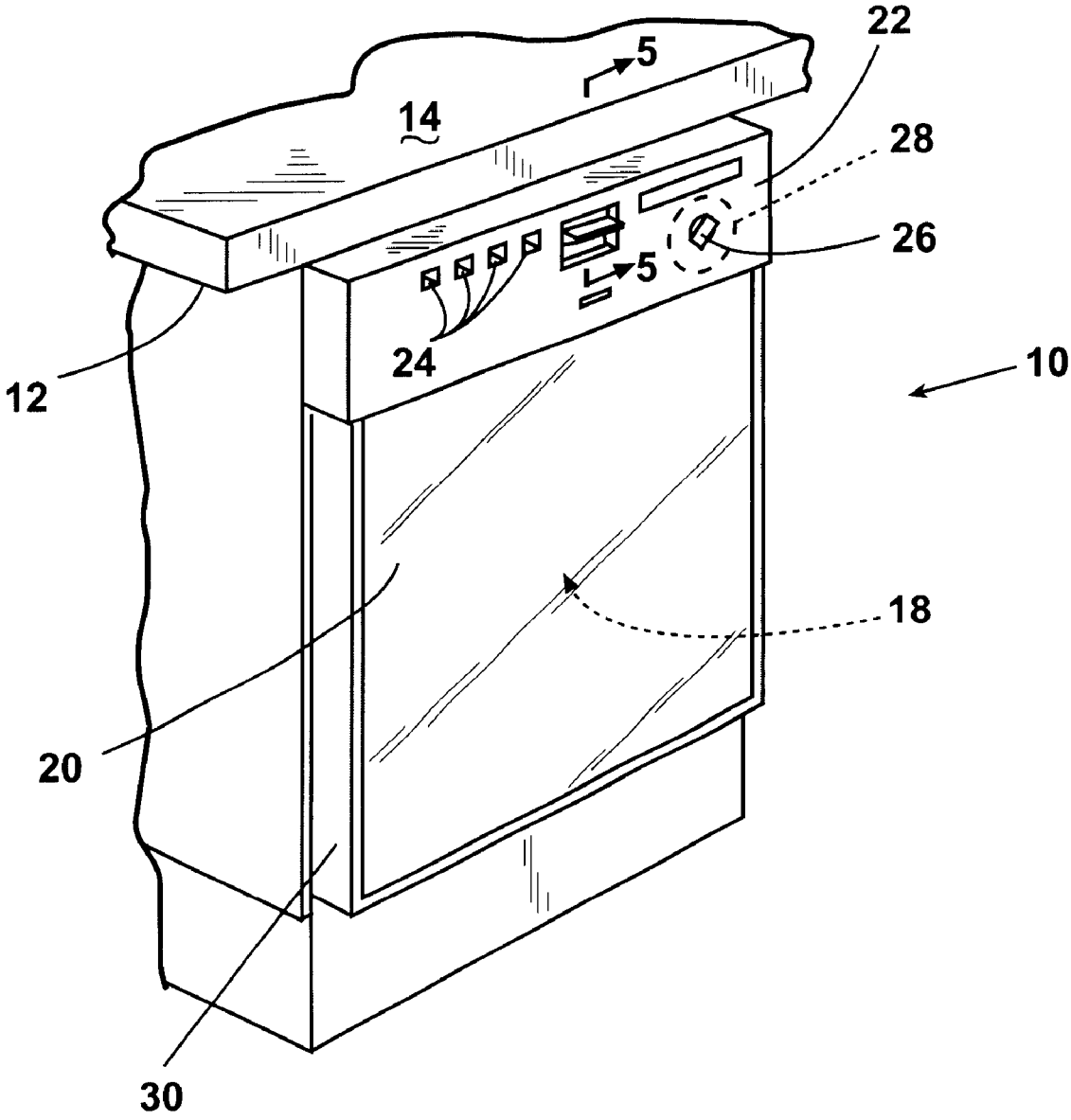
FIG. 1 is a perspective view of a dishwashing apparatus incorporating door latching structure according to the present invention.
Figure 5:
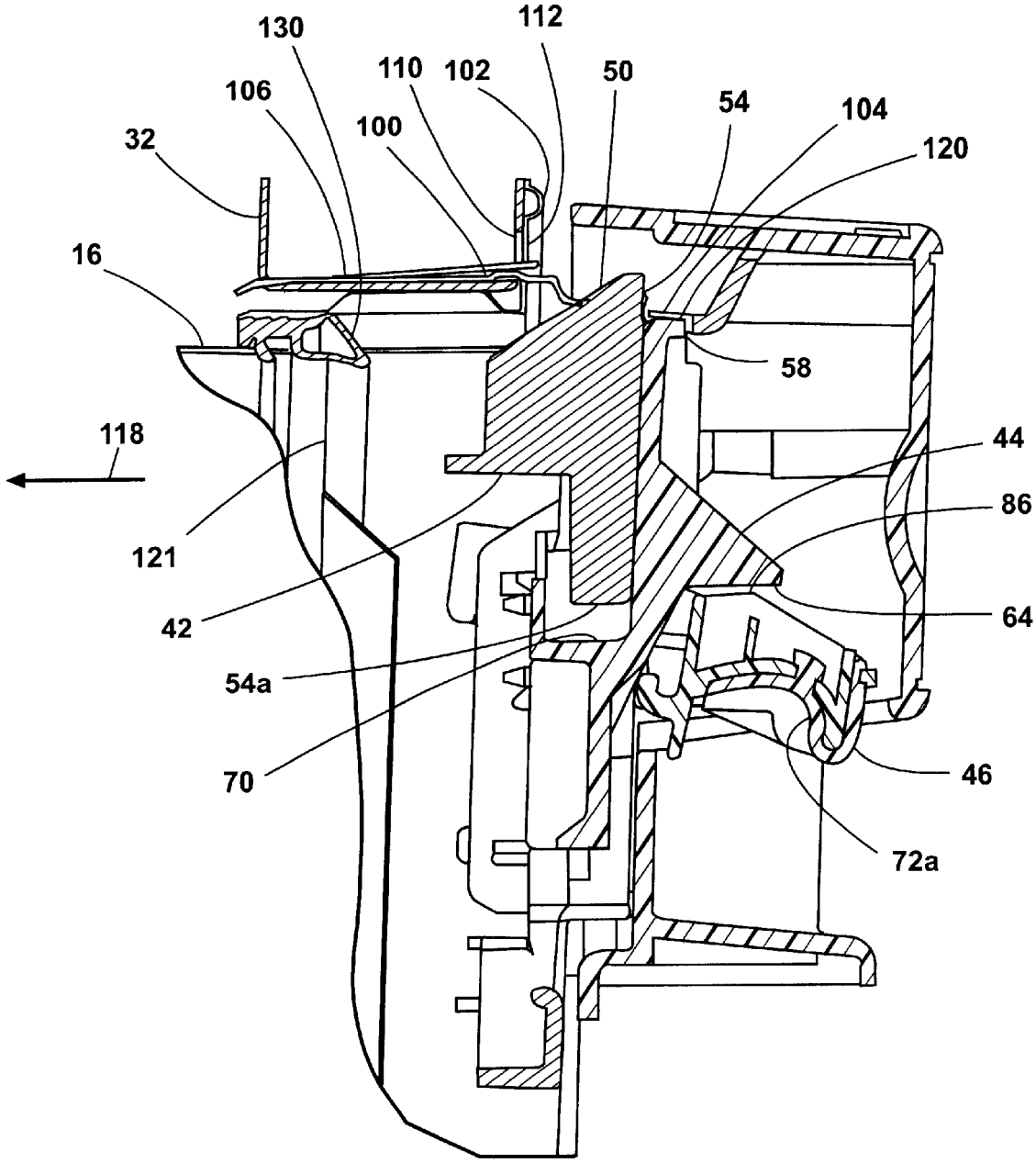
FIG. 5 is a sectional view of the door latching structure along line 5—5 of FIG. 1 with the door in its closed position.
Figure 6:
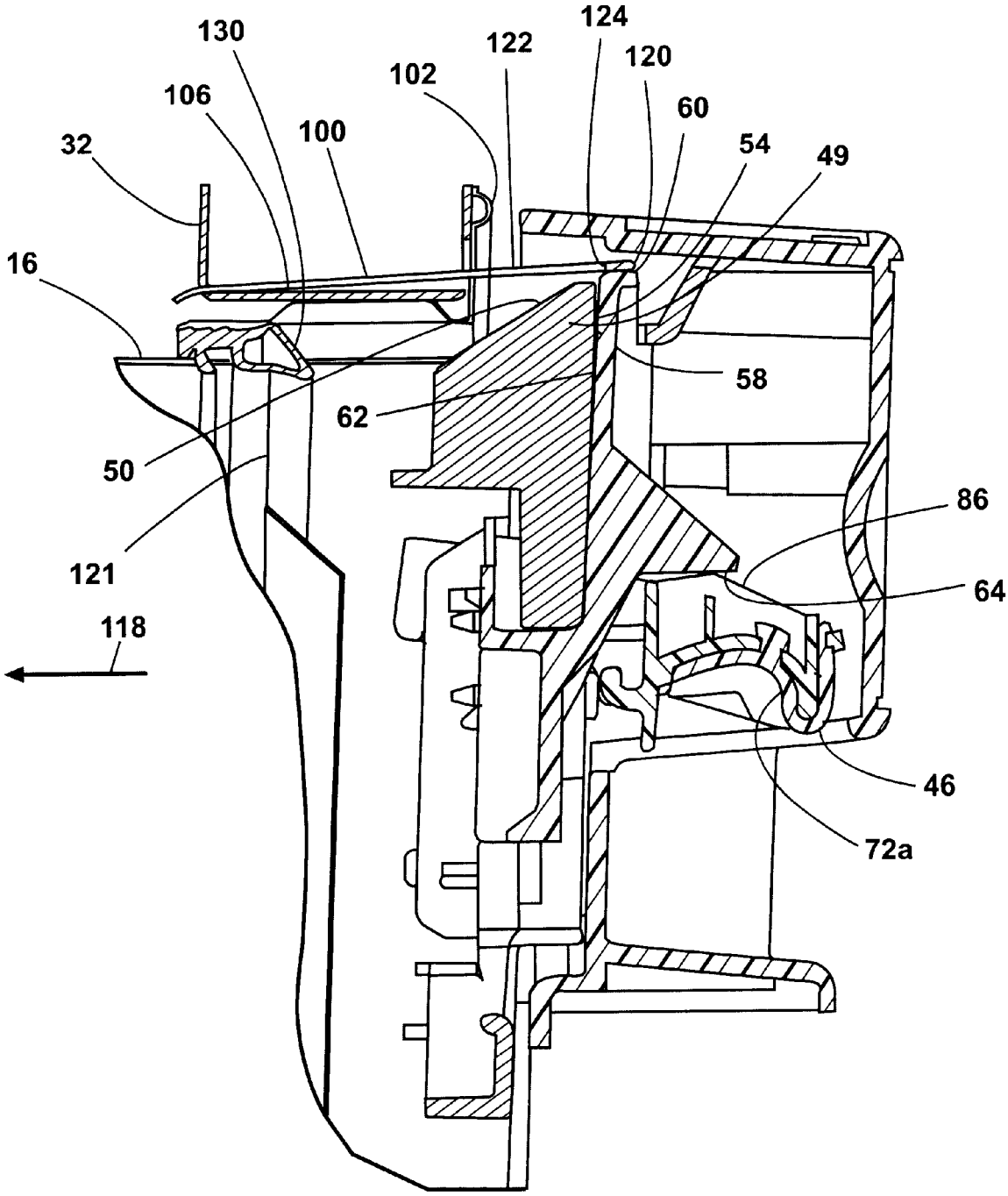
FIG. 6 is a sectional view of the door latching structure along the same line as FIG. 5 with the door in its latch release position.

In FIG. 1, a dishwashing apparatus suitable for the incorporation of the present invention, is shown at 10. The dishwasher in FIG. 1 is an under-the-counter design wherein the dishwasher 10 resides closely beneath the underside 12 of a counter 14. A tub 16 (FIG. 5) forms a wash chamber 18 which accepts a plurality of racks (not shown) for supporting dishes and utensils. The wash chamber 18 has an access opening at its front which opening is selectively closed by a hinged door 20, shown in FIG. 1 in its closed position. The door 20 has an associated console 22 which houses the control mechanism for the dishwashing apparatus and supports operator controls 24 and a manually operable cycling knob 26 for an electrical timer mechanism 28.

Figure 2:
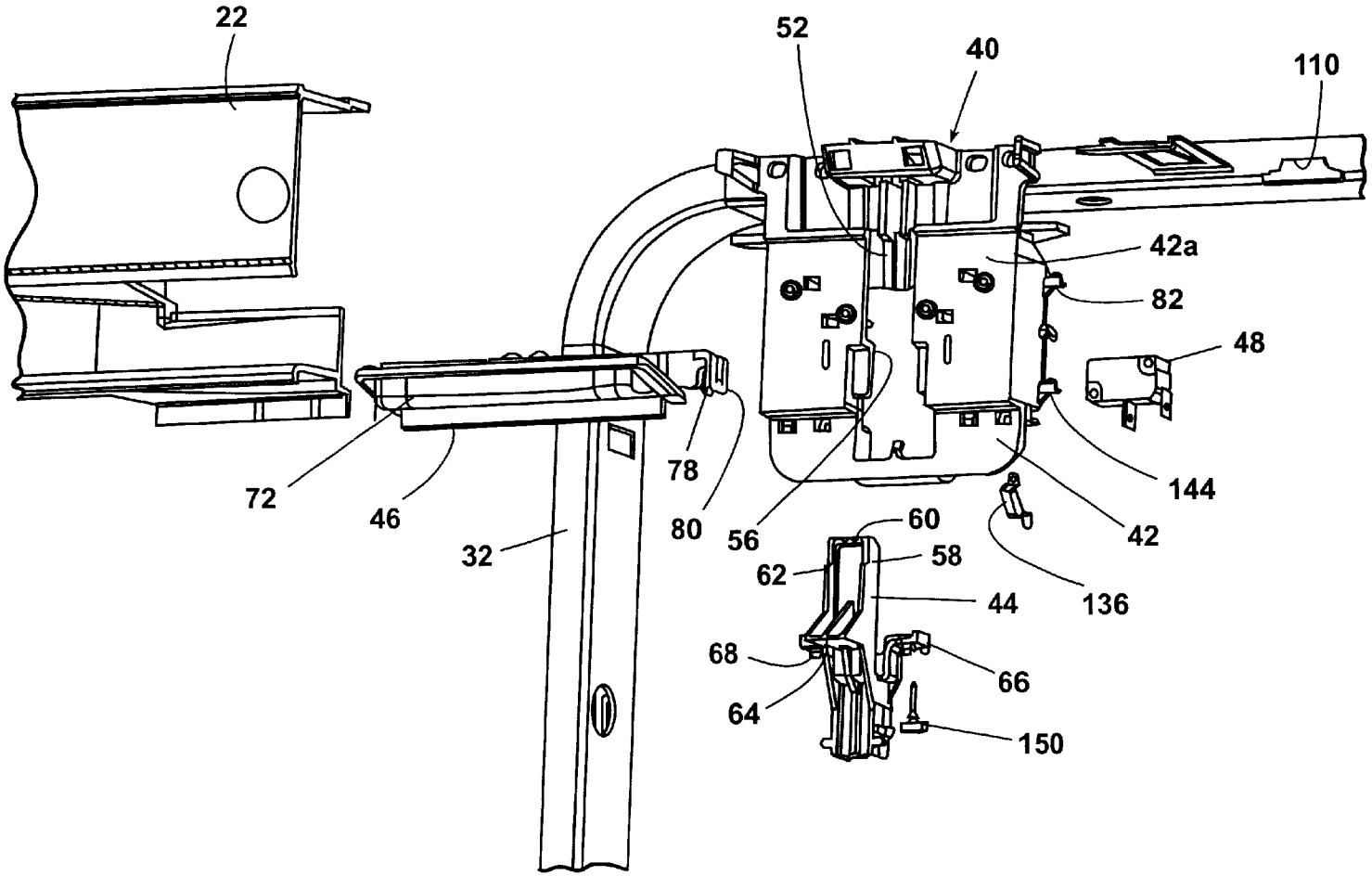
FIG. 2 is an exploded perspective view of the door of FIG. 1 and associated latching structure.
Figure 3:
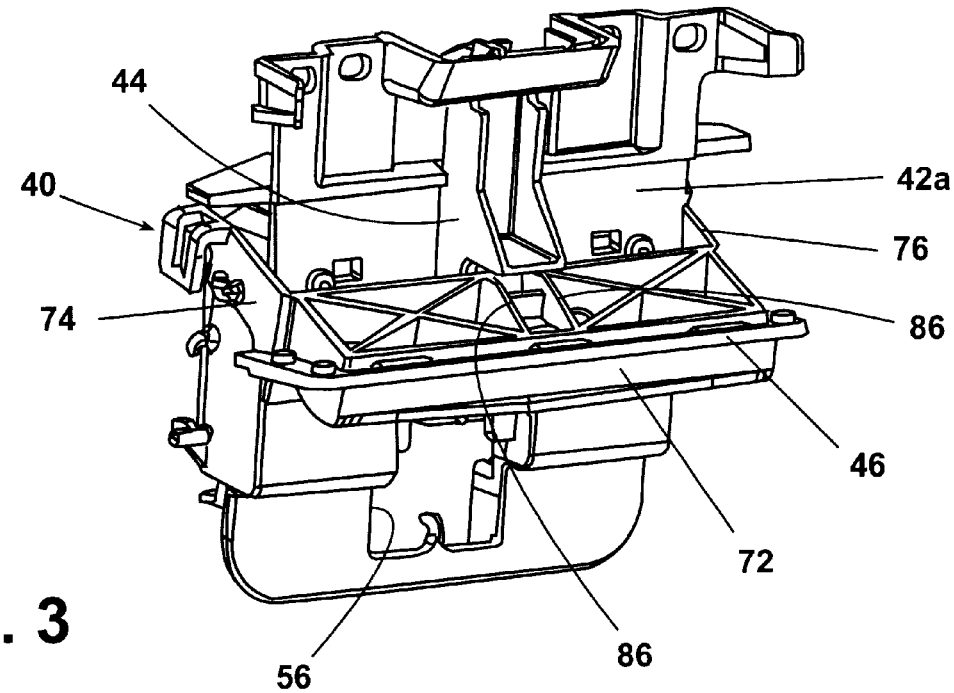
FIG. 3 is a front, perspective view of the assembled latching structure.
Figure 4:
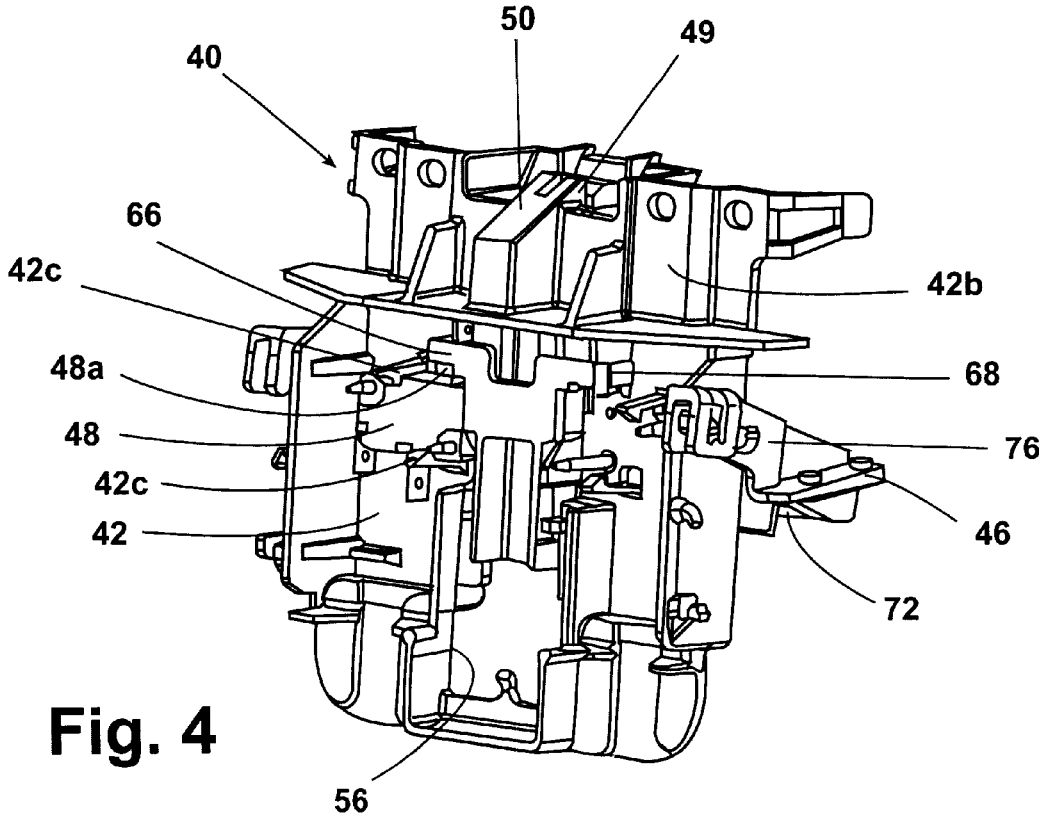
FIG. 4 is a rear, perspective view of the assembled latching structure.

As can be readily understood by one skilled in the art, the door 20 is hingedly supported to pivot about its bottom edge for selectively opening or closing the access opening of the wash chamber. The door may be include hinge portions (not shown) adjacent its bottom edge 30 for making pivotable connection with hinge elements that are part of a forward support frame element 32 (see FIG. 2) that extends peripherally up the sides and over the top of the tub 16. The frame element 32 is preferably made of metal, such as steel. With the door in the closed position of FIG. 1, the door 20 is selectively latched and released by a door latching mechanism at 40, at the upper portion of the door. It is this structure wherein the present invention is embodied. The door latching mechanism 40 is detailed in FIGS. 2–4.

The latching mechanism 40 includes a bolt 42, an actuator 44, a lever or handle 46 and a switch 48. In the preferred embodiment, the bolt is 42 is supported within the console 22. This may be accomplished by using threaded fasteners (not shown) to attach the bolt 42 to bosses (not shown) provided in the console. The bolt 42 includes a front surface 42*a* and a back surface 42*b*. When supported within the console 22, the back surface 42*b* faces into the wash chamber 18. A catch 49 is located along the top portion of the bolt 42 and includes a ramp surface 50 which is inclined upwardly from the back surface 42*b* towards the front surface 42*a*. Extending down from the ramp surface 50 along the front surface 42*a* is a guide channel 52. The guide channel also provides a forwardly facing shoulder surface 54. A center opening 56 is provided below the guide channel 52.

The actuator 44 is slidingly mounted to the bolt 42. The actuator 44 is an elongated member having a head portion 58 including a top contact surface 60 and a guide surface 62. The actuator 44 further includes a drive shoulder 64 and a pair of arms 66 and 68. When slidingly received onto the bolt 42, the actuator 44 is positioned such that the guide surface 62 resides closely, guidingly against the shoulder surface 54 of the bolt 42, the drive shoulder 64 extends outwardly from the front surface 42*a* and the arms 66 and 68 are positioned adjacent the back surface 42*b*. Sliding movement of the actuator 44 along the shoulder surface 54 is limited by engagement between the stop surface 54*a* of the bolt 42 and a stop surface 70 on the actuator 44.

The actuator 44 is connected to the bolt 42 by orienting the actuator perpendicular to the bolt 42 and inserting the head portion 58 through the center opening 56 from the back surface 42*b* side of the bolt 42. The head portion 58 passes through the center opening 56 until stopped by the arms 66 and 68 whereupon the actuator 44 may be rotated until the shoulder surface 54 engages the guide surface 62 and the arms 66 and 68 are disposed adjacent the back surface 42*b* of the bolt. Movement of the actuator 44 upward relative to the bolt 42, causes the side edges of the center opening 56 to be received into slots formed by a plurality of retention ribs provided on the bolt.

Once the actuator 44 is placed on the bolt 42, the switch 48 is connected to the back surface 42*b* of the bolt 42 by snap connectors 42*c* in an orientation such that the arm 66 is positioned to engage an outwardly biased button 48*a* of the switch 48. In this manner, when the actuator 44 is slid downward relative to the bolt 42, the arm 66 depresses the button 48*a* of the switch, thereby closing the switch 48. The switch 48 also serves to secure the actuator 44 to the bolt 42. By securing the switch 48 to the bolt 42 after the actuator 44 is assembled to the bolt 42, the actuator is prevented from disengaging from the bolt 42.

It can be readily appreciated by those skilled in the art that a second switch (not shown) may be used with the latching mechanism 40. The second switch can be snap connected to the back surface 42*b* of the bolt in a manner similar to the first switch 48. The second switch would include an outwardly biased button which would be actuated by the arm 68 of the actuator 44.

To improve the feel of the actuator 44 engaging the switch button 48*a*, the arms 66 and 68 may be provided with elastic bumpers 150. The bumpers 150 may be formed from a elastomeric or rubber-like material. Each of the bumpers 150 may includes a barbed post that inserts though a hole in the arm such that the bumper is securely connected to the arm.

The handle 46 includes an elongated body 72 having a grip surface 72*a* provided along the bottom surface of the elongated portion 72. A pair of arms 74 and 76 extend from opposite ends of the elongated portion 72. Each arm 74 and 76 includes a U-shaped slot 78 and a snap connect arm 80 such that the arms 74 and 76 may be pivotably connected to a pair of pivot pins 82 extending from the side of the bolt 42. In this way, the handle 46 is pivotably connected to the bolt 42 and extends outwardly beyond the front surface 42*a* of the bolt 42. A drive surface 86 is provided along the top surface of the elongated body 72. The drive surface 86 may be formed by a pair of ribs located generally in the middle of the elongated body.

The latch mechanism 40 is configured to selectively latch and release the door 20 by selectively capturing a strike plate 100 extending from the dishwasher tub 16. The strike plate 100, preferably made of spring steel, is carried in cantilever fashion by the frame element 32 and projects forwardly of the front edge 102 of the tub 16. The strike plate 100 has a forward latching portion 104, which engages the bolt 42, and a mounting portion 106, which is mounted to the frame 32.

The frame element 32 has a U-shaped cross section such that the frame forms a U channel configuration. The frame element 32 has a cut-out 110 through which the strike plate 100 extends. The front edge 102 of the tub includes a corresponding cut out area 112 through which the strike plate extends. The strike plate is fastened to the frame element 32 through any known connection means including fasteners, adhesives or welding.

The strike plate 100 is able to flex or deflect vertically. In its relaxed state, the latching portion 104 of the strike plate is bent slightly downwardly and extends outwardly from the tub front surface or edge 102. As the door 20 is moved to its closed position in the direction of arrow 118, a forward edge 120 at the free end of the strike plate 100 passes through an opening provided in the innerdoor liner 121 and encounters the ramp surface 50 of the bolt 42 progressively deflecting the latching portion 104 of the strike plate upwardly. Upon the door reaching the closed position, the top portion of the bolt 42 projects through a rectangular cut-out 122 on the strike plate 100 and allows the latching portion 104 of the strike plate to deflect downwardly into the position shown in FIG. 5, which represents the latched position of the door.

In the latched position, a rearwardly facing latching edge 124 of the strike plate bounding the cut-out 122 seats behind the shoulder surface 54 such that the strike plate 100 is engaged by the latch 49 and opening of the door is prohibited. At the same time, the forward edge 120 of the strike plate 100 bears directly against the top contact surface 60 of the actuator 44 to bias the actuator 44 downward. Movement of the actuator 44 downward causes the actuator 44 to depress the switch button 48*a* and to close the switch. It can be seen, therefore, that the switch 48 will be closed upon the door being properly latched. In the latched position, inner door liner 121 is urged compressively against a resilient seal 130 about the access opening.

To release the door from its latched state, the handle 46 is grasped by a dishwasher operator at grip surface 72*a* and pulled upwardly. This causes the drive surface 86 of the handle 46 to engage the drive shoulder 64 of the actuator 44, thereby moving the actuator upwardly. As the actuator is moved upwardly, the top contact surface 60 pushes the forward edge 120 of the strike plate 100 upwardly until the strike plate 100 clears the top portion of the bolt 42. At the same time, the switch button 48*a* is released to its upward open state. Once the strike plate 100 clears the top portion of the bolt 42, the door 20 can then be pivoted to its open position.

The present invention offers many improvements over the prior art. In particular, the latching mechanism beneficially separates the handle 46 from the actuator 44 such that the weight of the handle 46 does not press down upon the outwardly biased button of the switch 48. This is important due to the fact that the buttons of snap action switches such as the switch 48 are designed to have a particular actuation or operating force. If the handle 46 were to be directly connected to the actuator 44, the combined weight of these two elements may be sufficient to overcome the actuating force of the switch button 48 such that the switch 48 would close even though the door 20 is not fully closed. Additionally, by separating the handle 46 and actuator 44, the switch 48 can not be improperly closed by a dishwasher user pulling down on the handle 46. Since the handle 46 is separated from the actuator 44, only the action of the strike plate 100 can drive the actuator downwardly to close the switch 48.

An additional benefit of the present invention is that it provides for flexibility in the design of the handle 46. The handle can be fabricated with a flexible vinyl overmold thereby giving the handle a "soft touch" feature. Moreover, the handle can be biased into a downward position by a one of more springs 136, extending between the handle 46 and the bolt 42. The use of springs to bias the handle 46 downward can enhance the perception of quality.

Figure 7:
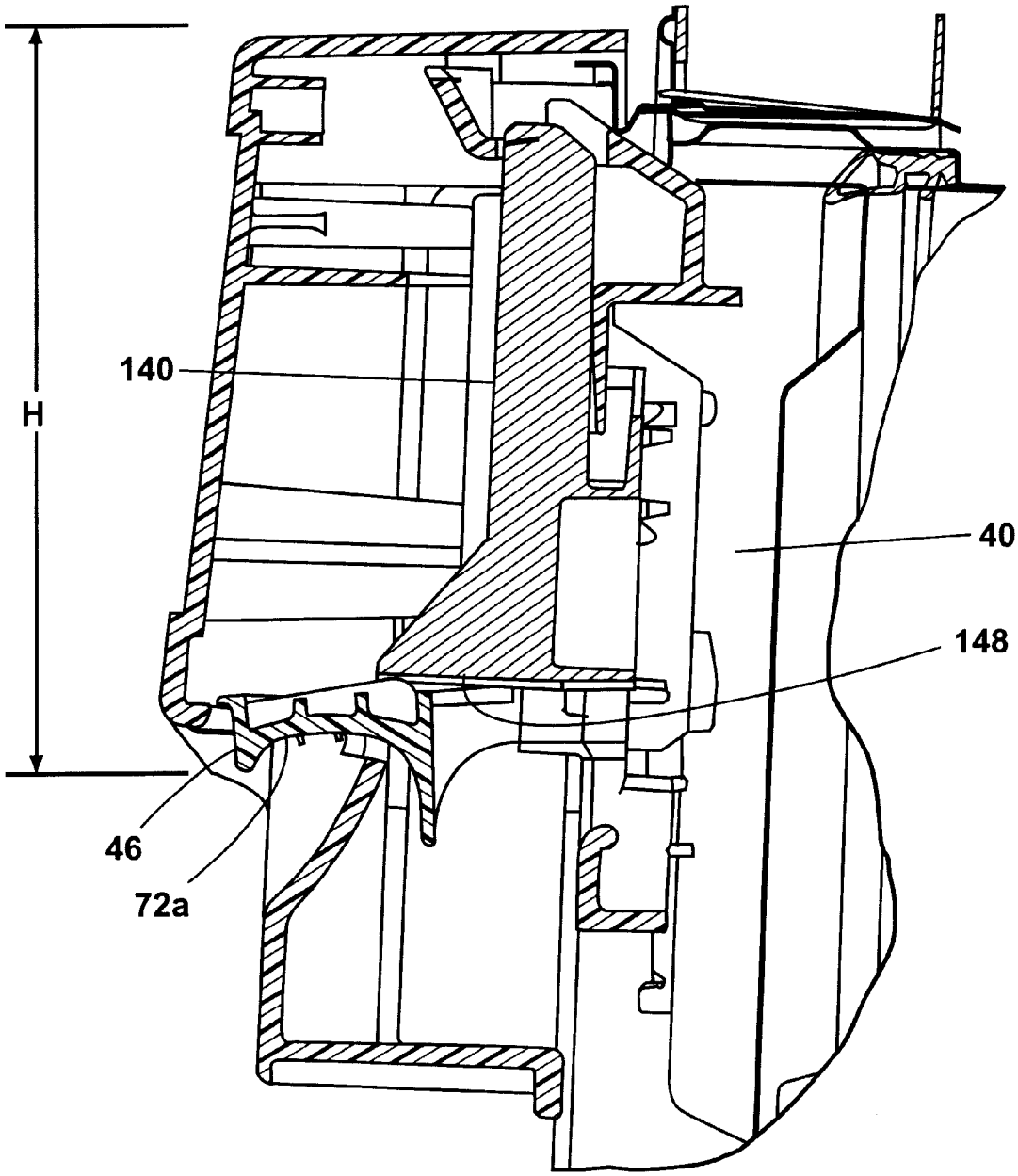
FIG. 7 is a sectional view of an alternative embodiment of the door latching structure showing an alternate actuator.

Turning now to FIG. 7, an alternative actuator 140 can be seen. The alternative actuator 140 is designed to allow the latch mechanism 40 to support the handle 46 at different vertical locations. In particular, the dimension H is greater in the embodiment using the alternate actuator 140 versus the actuator 44. When the actuator 140 is used, the handle 46 may be pivotably connected to the bolt 42 via the pivot pins 144 (see FIG. 2). The handle connects to the bolt 42 in the same way as discussed above. The actuator 140 includes a drive shoulder 148 which is located near the bottom edge of the actuator 140. In this way, the handle can operate to move the actuator upwardly when it is pivotably connected to the pivot pins 144. The manner in which the actuator acts to depress the switch button 48*a* and release the strike plate from the catch is similar to that described above.

The foregoing disclosure of specific embodiments is intended to be illustrative of the concepts comprehended by the invention. Although the invention has been described and illustrated in detail, it is to be clearly understood that the same is intended by way of illustration and example only and is not to be taken by way of limitation. For example, the configuration of the bolt, handle, switch and actuator may be modified and still fall within the claimed invention. The bolt could be formed without a center opening or could be changed in other ways. The actuator could connect to the bolt in any sliding manner. The switch could be attached to the bolt using threaded fasteners. Many other changes can be readily appreciated by one skilled in the art. Accordingly, the spirit and scope of the invention are to be limited only by the terms of the appended claims.

We claim:

1. A latch assembly for a dishwasher including a door having a front surface and a back surface and a tub, the latch assembly comprising:

a bolt secured in a fixed position to the door, the bolt including a catch including a ramp surface facing toward the tub;

an actuator slidably connected to the bolt, the actuator having a top contact surface and a drive shoulder;

a switch secured to the bolt, the switch having a outwardly biased button and being mounted to the bolt such that movement of the actuator may selectively depress the outwardly biased button;

a handle moveably mounted to the bolt in a position for access from the front surface of the door, the handle having a drive surface;

a strike plate having a forward latching portion including a forward edge extending outwardly from the tub toward the rear surface of the door, the strike plate being able to flex vertically and wherein upon the door moving toward a closed position the forward edge encounters the ramp surface and is deflected upwardly and upon the door reaching a closed position the latching portion of the strike plate clears the latch and deflects downwardly thereby contacting the actuator and forcing the actuator downwardly such that the outwardly biased button is depressed, wherein the strike plate may be released from the latch by upwardly moving the handle such that the drive surface of the handle engages the drive shoulder of the actuator moving the actuator upwardly such that the top contact surface forces the latching portion of the strike plate upwardly until the strike plate clears the catch of the bolt wherein the door may be pivoted to an open position.

2. A latch assembly for a dishwasher including a door having a front surface and a back surface and a tub, the latch assembly comprising:

a bolt secured in a fixed position to the door, the bolt including a catch including a ramp surface facing toward the tub;

an actuator slidably connected to the bolt, the actuator having a top contact surface and a drive shoulder;

a switch secured to the bolt, the switch having a outwardly biased button and being mounted to the bolt such that movement of the actuator may selectively depress the outwardly biased button, wherein the switch connects to the bolt to interfere with the removal of the actuator from the bolt such that the actuator is secured to the bolt;

a handle moveably mounted to the bolt in a position for access from the front surface of the door, the handle having a drive surface;

a strike plate having a forward latching portion including a forward edge extending outwardly from the tub toward the rear surface of the door, the strike plate being able to flex vertically and wherein upon the door moving toward a closed position the forward edge encounters the ramp surface and is deflected upwardly and upon the door reaching a closed position the latching portion of the strike plate clears the latch and deflects downwardly thereby contacting the actuator and forcing the actuator downwardly such that the outwardly biased button is depressed, wherein the strike plate may be released from the latch by upwardly moving the handle such the drive surface of the handle engages the drive shoulder of the actuator moving the actuator upwardly such that the top contact surface forces the latching portion of the strike plate upwardly until the strike plate clears the catch of the bolt wherein the door may be pivoted to an open position.

3. The latch assembly for a dishwasher according to claim 1 wherein the handle is pivotably connected to the bolt.

4. The latch assembly for a dishwasher according to claim 3 wherein the handle includes an elongated portion with a pair of arms, the elongated portion having a grip surface.

5. The latch assembly for a dishwasher according to claim 4 wherein the grip surface received an elastomeric overmold.

6. The latch assembly for a dishwasher according to claim 1, further wherein:

the bolt includes a front surface, a back surface, a center opening and a guide channel having a forwardly facing shoulder surface, the guide channel extending from the center opening toward the catch;

the actuator having a head portion and an arm, the head portion including the top contact surface and a guide surface, wherein the actuator is assembled to the bolt by orienting the actuator perpendicular to the bolt and inserting the head portion from the back surface side of the bolt through the center opening until stopped by the arm whereupon the actuator is rotated until the guide surface engages the shoulder surface of the bolt and the arm is disposed adjacent the back surface of the bolt.

7. A latch assembly for a dishwasher including a door having a front surface and a back surface and a tub, the latch assembly comprising:

a bolt secured in a fixed position to the door, the bolt including a catch including a ramp surface facing toward the tub wherein the bolt includes a front surface, a back surface, a center opening and a guide channel having a forwardly facing shoulder surface, the guide channel extending from the center opening toward the catch;

an actuator slidably connected to the bolt, the actuator having a top contact surface and a drive shoulder, the actuator having a head portion and an arm, the head portion including the top contact surface and a guide surface, wherein the actuator is assembled to the bolt by orienting the actuator perpendicular to the bolt and inserting the head portion from the back surface side of the bolt through the center opening until stopped by the arm whereupon the actuator is rotated until the guide surface engages the shoulder surface of the bolt and the arm is disposed adjacent the back surface of the bolt;

a switch secured to the bolt, the switch having a outwardly biased button and being mounted to the bolt such that movement of the actuator may selectively depress the outwardly biased button wherein the switch connects to the back surface of the bolt to interfere with the removal of the actuator from the bolt wherein the actuator is secured to the bolt and the arm is positioned for engaging the outwardly biased button of the switch;

a handle moveably mounted to the bolt in a position for access from the front surface of the door, the handle having a drive surface;

a strike plate having a forward latching portion including a forward edge extending outwardly from the tub toward the rear surface of the door, the strike plate being able to flex vertically and wherein upon the door moving toward a closed position the forward edge encounters the ramp surface and is deflected upwardly and upon the door reaching a closed position the latching portion of the strike plate clears the latch and deflects downwardly thereby contacting the actuator and forcing the actuator downwardly such that the outwardly biased button is depressed, wherein the strike plate may be released from the latch by upwardly moving the handle such the drive surface of the handle engages the drive shoulder of the actuator moving the actuator upwardly such that the top contact surface forces the latching portion of the strike plate upwardly until the strike plate clears the catch of the bolt wherein the door may be pivoted to an open position.

8. The latch assembly for a dishwasher according to claim 1 wherein the bolt includes a first set of pivot pins for pivotably mounting the handle at a first position and a second set of pivot pins for mounting the handle at a second position.

9. The latch assembly for a dishwasher according to claim 1 further wherein the bolt includes a front surface and a back surface, the actuator includes an arm which is disposed adjacent the bolt when the actuator is slidingly attached to the bolt, and the switch is connected to the back surface of the bolt by snap connectors and interferes with the actuator arm such that the actuator is secured to the bolt.

10. A latch assembly for a dishwasher including a door having a front surface and a back surface and a tub, the latch assembly comprising:

a bolt secured in a fixed position to the door, the bolt including a catch including a ramp surface facing toward the tub, and the bolt includes a front surface and a back surface;

an actuator slidably connected to the bolt, the actuator having a top contact surface and a drive shoulder, and the actuator includes an arm which is disposed adjacent the bolt when the actuator is slidingly attached to the bolt;

a switch secured to the bolt, the switch having a outwardly biased button and being mounted to the bolt such that movement of the actuator may selectively depress the outwardly biased button, wherein the switch is connected to the back surface of the bolt by snap connectors and interferes with the actuator arm such that the actuator is secured to the bolt;

a handle moveably mounted to the bolt in a position for access from the front surface of the door, the handle having a drive surface;

a strike plate having a forward latching portion including a forward edge extending outwardly from the tub toward the rear surface of the door, the strike plate being able to flex vertically and wherein upon the door moving toward a closed position the forward edge encounters the ramp surface and is deflected upwardly and upon the door reaching a closed position the latching portion of the strike plate clears the latch and deflects downwardly thereby contacting the actuator and forcing the actuator downwardly such that the outwardly biased button is depressed, wherein the strike plate may be released from the latch by upwardly moving the handle such the drive surface of the handle engages the drive shoulder of the actuator moving the actuator upwardly such that the top contact surface forces the latching portion of the strike plate upwardly until the strike plate clears the catch of the bolt wherein the door may be pivoted to an open position;

further wherein the arm of the actuator is positioned for selectively depressing the outwardly biased button, the latch assembly further comprising:

a bumper connected to the arm for cushioning the contact of the arm and the outwardly biased button.

* * * * *